United States Patent [19]

Mehl et al.

[11] 4,246,331

[45] Jan. 20, 1981

[54] ELECTROPHOTOGRAPHIC DEVELOPERS CONTAINING SUBLAMINATE DYES

[75] Inventors: Wolfgang Mehl; Dieter Hendriks, both of Genéva, Switzerland

[73] Assignee: Sublistatic Holding SA, Glaris, Switzerland

[21] Appl. No.: 17,774

[22] Filed: Mar. 5, 1979

Related U.S. Application Data

[63] Continuation of Ser. No. 843,085, Oct. 17, 1977, abandoned, which is a continuation of Ser. No. 524,339, Nov. 19, 1974, abandoned.

[30] Foreign Application Priority Data

Nov. 30, 1973 [CH] Switzerland ..... 16831/73

[51] Int. Cl.[3] ..... G03G 9/14

[52] U.S. Cl. ..... 430/107; 430/106; 8/470

[58] Field of Search ..... 252/62.1 R, 62.1P; 96/15 D, 1.2; 8/2, 2.5 A; 430/106, 107

[56] References Cited

U.S. PATENT DOCUMENTS

| | | | |
|---|---|---|---|
| 3,060,051 | 10/1962 | Johnson et al. | 96/1.2 X |
| 3,386,379 | 6/1968 | Gundlach et al. | 101/469 |
| 3,639,245 | 2/1972 | Nelson | 252/62.1 P |
| 4,145,300 | 3/1979 | Hendriks | 252/62.1 P |

FOREIGN PATENT DOCUMENTS 433434 2/1968 Japan .

*Primary Examiner*—Roland E. Martin, Jr.

*Attorney, Agent, or Firm*—Sprung, Felfe, Horn, Lynch & Kramer

[57] ABSTRACT

An electrophotographic developer is composed of particles comprising magnetic cores which are coated with an organic substance and at least one dyestuff which passes into the vapour state at a temperature in the range of from 100° to 220° C. at atmospheric pressure.

15 Claims, No Drawings

ELECTROPHOTOGRAPHIC DEVELOPERS CONTAINING SUBLAMINATE DYES

This is a continuation of application Ser. No. 843,085, filed Oct. 17, 1977, now abandoned, which in turn is a continuation of Ser. No. 524,339, filed Nov. 19, 1974, now abandoned.

The present invention relates to a powder which can be used in electrophotographic recording and to a process for manufacturing such a powder. It relates more particularly to dry particles comprising a magnetic (or ferromagnetic) core coated with an organic substance; these particles form a powder developer for electrophotography, which is generally called a "toner".

In processes for the reproduction of images by electrophotography, an electrostatic image (latent image) is formed on a photoconducting insulating surface, and this electrostatic image is then developed by means of finely divided developers. The developed image can then be fixed in position or transferred to a copy-sheet on which it is fixed permanently. The photoconducting insulating layer is generally charged first, in order to render it sensitive, and then it is exposed to a light image or some other pattern of activated electromagnetic radiation in order to dissipate the charge from the zones which the radiation strikes. A latent image is thus formed which corresponds to the pattern of electromagnetic radiation striking the plate. As indicated above, this image can then be developed or rendered visible by depositing on the plate a "toner", that is to say a finely divided coloured material which is attracted by the static electricity remaining on the plate.

Developers comprising two components are known in electrophotography, but developers in which all the particles have the same composition are also known. The developers of the present invention are of the latter type. They are intended to be used in the developing process employing magnetic brushes.

The developers of the present invention are characterised in that the organic material, generally a polymer, which coats the magnetic particles contain a dyestuff which, at atmospheric pressure, passes into the vapour state between 100° and 220° C. They thus comprise a ferromagnetic core, for example made of iron. Other ferromagnetic materials such as magnetic alloys and oxides of cobalt, nickel, iron and the like are also suitable. The size of the core is generally between 0.5 and 10 microns.

The materials covering the ferromagnetic core of the developers of the present invention can be chosen from amongst polymers of the most diverse categories, such as polysaccharide ethers and esters and more particularly cellulosic ethers and esters such as cellulose acetate or acetobutyrate and ethyl- or benzyl-cellulose, polyamides such as the Versamides of General Mills and the Vestamides of Chemische Werke Hülls (sic) AG, polyesters, polyolefines and resins of all types, including polymers and copolymers such as the copolymers of styrene and butadiene etc.; of these products, those which have the least affinity for the dyestuffs which they contain are preferred, so that, under the effect of heat, the said dyestuffs move readily from the developer to the surfaces with which they are kept in contact when making a copy.

The ferromagnetic cores can be covered with the products mentioned above by any suitable means whatsoever, such as immersion, vaporisation, stirring the cores with a coating solution in a barrel or by means of a controlled fluidised bed. The fluidised bed process is preferable because it enables a uniform covering to be applied to the cores of the particles, and this is a process which is well known in the prior art.

In the fluidised bed process, the cores are suspended and made to flow in an ascending stream of heated gas such as air, so that the particles travel upwards and are covered with the coating material in a first zone. Thereafter, in a second zone, the particles are stabilised in a stream of air, the speed of which is lower, and the liquid which is a solvent and/or a dispersing agent for the coating covering, evaporates to leave a thin solid covering on the particles. The particles are conveyed back to the first zone so that successive layers of the covering material are produced on the core in a uniform manner. A further and very suitable method of preparation is the spray drying method according to which excellent developers may be made by appropriately choosing the spray-drying temperature.

It is also possible, by choosing the desired conditions of time and temperature, to vary the thickness of the covering at will. It is, however, advantageous not to exceed a thickness of a few microns, a thickness of 2–10 microns being already sufficient to ensure that the covering is physically continuous and to provide an amount of material such that it can absorb sufficient dyestuff to give dark copies, if so desired.

The dyestuffs which characterise the developers of the present invention can be chosen from the category of so-called basic dyestuffs (cationic dyestuffs) or from the category of disperse dyestuffs, and even from the category of so-called solvent dyes.

Those dyestuffs from the abovementioned categories which sublime or vaporise between 100° and 220° C. at atmospheric pressure can be incorporated into the organic covering of the ferromagnetic particles of the developers of the present invention. They can be azo dyestuffs or anthraquinone dyestuffs, quinophthalone derivatives, styryl derivatives, di- and tri-phenylmethanes, oxazine or thiazine derivatives, xanthene, methines and azomethines, acridine and diazine derivatives and the like.

The following compounds will be mentioned more particularly:

1,4-Dimethylaminoanthraquinone, brominated or chlorinated 1,5-dihydroxy-4,8-diamino-anthraquinone, 1,4-diamino-2,3-dichloro-anthraquinone, 1-amino-4-hydroxy-anthraquinone, 1-amino-4-hydroxy-2-(β-methoxy-ethoxy)-anthraquinone or 1-amino-4-hydroxy-2-phenoxy- or -methoxy-anthraquinone, the methyl, ethyl, butyl or propyl ester of 1,4-diamino-anthraquinone-2-carboxylic acid, 1-amino-4-anilido-anthraquinone, 1-amino-2-cyano-4-anilido- or cyclohexylamino-anthraquinone, 1-hydroxy-2-(p-acetaminophenylazo)-4-methyl-benzene, 3-methyl-4-(nitro-phenylazo)-pyrazolone, a-(nitrophenylazo)-acetoacetylanilide, 3-hydroxy-quinophthalone, and finally basic dyestuffs such as Malachite Green, Methyl Violet and the following dyestuffs (after modification using sodium acetate, sodium ethylate or even sodium methylate): No. 42037, 42140, 45006, 46025, 48013, 48020, 48035, 50045, 51005 and 52010 of the Colour Index edited by "The Society of Dyers and Colourists" and "The American Association of Textile Chemists and Colorists" (2nd Edition, 1956).

In addition to hydroxy-quinophtalone, it is advantageous to use those of the dyestuffs indicated which possess at least two substituents, preferably different from one another. Thus, three developers are obtained, which make it possible to make coloured copies, by using as the yellow dyestuff: hydroxy-quinophthalone, as the red dyestuff: 1-amino-2-phenoxy-4-hydroxy-anthraquinone, and as the blue dyestuff: 1,4-dihydroxy-5-amino-8-isopropyl-amino-anthraquinone, and by preparing three separate developers, employing these dyestuffs.

It is advantageous to incorporate more than 2% (by weight), and preferably between 2.5 and 25% of dyestuff into the developers of the present invention, that is to say 10–50% preferably, 10–35% of dyestuff calculated on the weight of polymer present in the developer.

The dyestuffs can be incorporated into the material which coats the ferromagnetic cores of the developers of the present invention before or after the coating process. A very particularly advantageous process (because it enables large amounts of dyestuff to be introduced into the coating product) is to cause the dyestuff to enter (the coating material) by thermodiffusion, preferably under pressure, for example of at least 50 kg per $cm^2$. Another process consists of coating the ferromagnetic cores, which are already covered with polymer, with a resin or a polymer containing the dyestuff in dispersed form or in solution. This coating process can be effected by the known process of two-phase selective coating, the polymer to be coated being mixed in a two-phase system, one phase consisting of water and the other of a solution of the coating polymer in a solvent which is partially miscible with water; as water is added, so the coating polymer containing the dyestuff is deposited in fine layers on the polymer to be coated which covers the ferromagnetic particle. It is also possible to effect the process by vulcanisation or in accordance with the fluidised bed and spray-drying techniques.

By means of these processes, it is easy to prepare an electrophotographic developer, suitable for magnetic brush development, composed solely of particles comprising magnetic cores coated with an organic binder and at least one dyestuff, which dyestuff passes into the vapour state at a temperature in the range of from 100° to 220° C. at atmospheric pressure, and wherein the particles are spherical or spherelike shaped and have an average diameter of from 1 to 30 microns. Particularly advantageous are the developers wherein the magnetic cores consist of a ferromagnetic substance and represent at least 50% of the weight of the developer particles, while the organic binder is a polymer, preferably in an amount of less than 40% of the weight of the developer particles, the rest being formed of sublimable dyestuff and possibly also of carbon black.

The developers of the present invention contain advantageously less than 40% and preferably 10–30% (by weight) of polymer around the magnetic cores, this polymer being able to contain up to 50% (by weight) of sublimable dyestuff, but preferably 10–35%; the diameter of the developer particles preferably varies between 1 and 20 microns on average, that is to say that the polymer coated particles which form the new developers of the instant invention have a spherical shape; when viewed on the microscope they appear as little spheres or ovoidal grains some of which may have the appearance of broken spheres comprising magnetic cores coated with a polymer, it being possible for the resin or polymer to contain not only the sublimable dyes in the said amount but also up to 10% advantageously 3–7% of carbon black (by weight).

To form the cores of the developers of the present invention, magnetic particles are chosen as a function of their size and of the material used.

It is particularly advantageous to add to the developers of the present invention an anti-static agent which prevents agglomeration of the particles or even of the various adjuvants, these being mainly products which maintain the good rheological properties of the developers, such as the colloidal forms of pyrogenic silicic acid which can achieve sharpnesses of the order of half a micron and even less.

The developers of the present invention may be used for making copies of originals by using copying machines having a magnetic brush development. They can also be used for making colored copies of the original; for this purpose a latent image of an original, for example a latent electrophotographic image (such as they are usually obtained on zinc oxide paper) is first developed in a copying machine using a magnetic brush development and a developer of the present invention; the developed image is then heated at 180°–220° C. in contact with a receiving surface such as a polyester film or a paper coated or impregnated with a substance which has affinity for the subliming dyes present in the developer. Such receiving surface may also be a non-woven or a tissue of synthetic material such as knitted or woven fabrics of polyamide, of polyacrylonitrile or especially of polyethylene terephthalate.

The following non-limiting examples illustrate the present invention. In these examples, the parts and percentages are expressed by weight, unless otherwise indicated, and the temperatures are expressed in degrees centigrade.

EXAMPLE 1

A developer is prepared by mixing 4 parts of polyvinyl acetate and 6 parts of $Fe_3O_4$. Employing a fluidised bed installation and following a known method, a powder is obtained which consists of particles of $Fe_3O_4$ coated with polymer, the average diameter of which is 15 microns. 99% of the particles have a diameter greater than 2.5 microns and less than 30 microns.

This powder is mixed for two hours in a TURBULA ® apparatus (W. H. Bachofen, Bâle) with 2% of the red dyestuff 1-amino-4-hydroxy-2-(β-methoxyethoxy)-anthraquinone in the form of particles, the average diameter of which is 1 micron. The mixture thus obtained is thereafter heated at 60° C. for 10 hours and is then treated in the TURBULA for two hours with 0.5% of Cab-o-Sil ® Grade M5 (Cabot Corporation).

A latent image produced electrophotographically on a photoconducting paper containing zinc oxide is developed by applying thereto, by means of a magnetic brush, the pulverulent mixture described above.

The image developed is fixed by heating for a short time (a few seconds at 140° C.) which causes the polymer to soften.

The image thus developed and fixed is transferred to a receiving sheet of thickness 25 microns, by vapour phase transfer of the red dyestuff; in fact, it suffices to heat the combination (consisting of the paper containing zinc oxide and the receiving sheet), subjected to a pressure of 1 $g/cm^2$, for 10 seconds at 210° C.

Most of the dyestuff is transferred in this way and gives a faithful reproduction, in the red of the original. The red image obtained possesses excellent sharpness, good colour and spot-free background areas. No subsequent fixing operation is necessary.

The optical density is 1.5.

EXAMPLE 2

Particles containing a magnetic core, coated with polyvinyl acetate in accordance with the method of preparation described in Example 1, are ground in a TURBULA apparatus with 3% of the blue disperse dyestuff of the formula

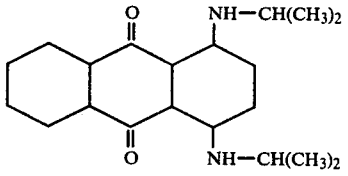

reduced to the form of particles of average diameter approximately 1 micron. The mixture is heated at 60° C. for 16 hours and after it has been cooled, 0.5% of a hydrophobic product, AEROSIL 972 manufactured by DEGUSSA, is added thereto.

The particles of the powder thus prepared flow freely and can be used, as is described in Example 1, to develop an electrostatic latent image produced on a photoconducting plate consisting of a paper containing zinc oxide. A blue reproduction of the original is obtained by transferring the blue dyestuff from the paper to a receiving sheet, simply by heating. As in Example 1, the blue image obtained possesses excellent sharpness, good colour and spot-free background areas. No subsequent fixing operation is necessary.

Instead of the above dyestuff, it is possible to use 3% of 1-amino-4-isopropylamino-quinizarine.

EXAMPLE 3

A developer is prepared from two parts of low molecular weight polyamides VERSAMID 930 supplied by GENERAL MILLS, 4 parts of iron powder (prepared by decomposition of iron carbonyl of the type G5-G or SF), the average size of which is approximately 2.5 microns, and 4 parts of magnetite ($Fe_3O_4$) particles, the average size of which lies between 0.03 and 0.06 microns.

To do this, the VERSAMID is dissolved in a mixture of 50% of toluene and 50% of n-propyl alcohol, and the magnetite and iron carbonyl are dispersed therein using a hall mill. This dispersion is spray-dried and, after evaporation of the solvent, a dry powder is obtained which is made up of particles consisting of an iron and magnetite core coated with polyamide. The portion of these particles, the sizes of which lie within the desired range, is then isolated by means of an air sieve; approximately 20% of all the particles are retained. These particles have an average diameter of 12 microns; 99.3% have a diameter greater than 3 microns and 99.5% have a diameter less than 30 microns.

This powder is redispersed in an aqueous solution containing 1% of the anti-static agent ZEROSTAT P® supplied by CIBA-GEIGY, in order to prevent the particles of developer from becoming charged by rubbing against one another, as this would result in the appearance of defects when the electrostatic image was developed.

4 Parts of a dyestuff dispersion, consisting of 3.7 parts of the yellow dyestuff of the formula

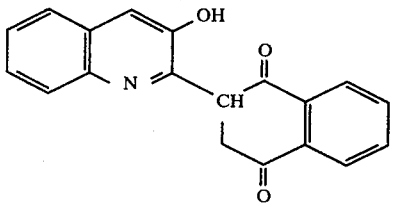

8 parts of the red dyestuff mentioned in Example 1, 5 parts of 1,4-dimethylaminoanthraquinone and 5 parts of brominated 1,5-dihydroxy-4,8-diamino-anthraquinone per 200 parts of water and 0.5 part of TEEPOL, are added to 96 parts of the abovementioned dispersion. After having mixed the whole for 2 hours, the solid material is filtered off and dried for 3 hours at 70° C.

This dry powder thus obtained is then mixed for 2 hours with 0,5% of AEROSIL® 200 supplied by DEGUSSA, Frankfurt, in a TURBULA apparatus.

A developer consisting of particles which flow freely is thus obtained. It can be applied, by means of a magnetic brush, to an electrophotographic latent image in order to develop the latter as described in Example 1.

After fixing the image thus developed on the paper containing zinc oxide, the dyestuffs present in this image are transferred to a receiving sheet.

The reproduction in black of the original is obtained electrophotographically, with a maximum optical density of 2.0.

What we claim is:

1. An electrophotographic developer, suitable for magnetic brush development, composed solely of particles comprising magnetic cores consisting of a ferromagnetic substance and representing at least 50% of the weight of the developer particles, coated with an organic binder, devoid of wax and containing more than 10% of at least one dyestuff, which dyestuff passes into the vapour state at a temperature in the range of from 100° to 220° C. at atmospheric pressure and is a monoazo, anthraquinone, quinophthalone or styryl dyestuff, and wherein the particles are spherical or spherlike shaped and have an average diameter of from 1 to 30 microns.

2. A developer as in claim 1, wherein the organic binder is a polymer.

3. A developer as in claim 2, wherein the polymer represents 10 and 40% of the weight of the developer particles.

4. A developer as in claim 2, wherein the magnetic cores are coated with a synthetic polymer which does not fuse below 150° C.

5. A developer as claim 2 wherein the coating polymer is a polyamide resin.

6. A developer as in claim 2, wherein the coating polymer is a member selected from the group consisting of an epoxy resin, a cellulose ether or butadiene copolymer.

7. A developer as in claim 3 wherein the polymer also contains up to 10% of carbon black.

8. A developer as in claim 2 wherein the sublimable dyestuff is a monoazo dyestuff.

9. A developer as in claim 2 wherein the polymer coating the magnetic cores has a thickness of form 2 to 10 microns.

10. A developer as in claim 2, wherein the coated ferromagnetic cores are in the form of small spheres of diameter 1 to 10 microns.

11. A developer as in claim 2 wherein the polymer coating contains an anti-static agent.

12. A developer as in claim 6 wherein the polymer coating contains a very fine silicon oxide powder.

13. An electrophotographic developer as in claim 2 wherein the polymer coating contains 10–50% of a sublimable dyestuff.

14. An electrophotographic developer as in claim 2 wherein the polymer coating contains a member selected from the group consisting of 1-amino-2-methoxy- or phenoxy-4-hydroxy anthraquinone, 1-amino-2,B-methoxyethoxy-4-hydroxy-anthraquinone, a hydroxyquinophthalone and 1,4-dihydroxy-5-amino-8-isopropylaminoanthraquinone.

15. A developer as in claim 1 wherein the sublimable dyestuff possesses at least two substituents different from one another.

* * * * *